US005958642A

United States Patent [19]

Takagi et al.

[11] Patent Number: 5,958,642

[45] Date of Patent: Sep. 28, 1999

[54] TONER FOR DEVELOPING AN ELECTROSTATIC CHARGE IMAGE, DEVELOPING AGENT FOR ELECTROSTATIC CHARGE IMAGE AND IMAGE FORMATION METHOD

[75] Inventors: Shinpei Takagi; Yasuhiro Oya, both of Odawara; Etsuo Tominaga, Minamiashigara; Toyohumi Inoue, Hiratsuka; Tomohiro Takeda, Hadano; Masahiro Uchida, Minamiashigara; Haruhide Ishida, Hadano; Kouzou Ota, Odawara; Hirokazu Hamano, Kaisei; Yusaku Shibuya, Odawara; Jun Igarashi, Odawara; Atsuhiko Eguchi, Odawara; Yutaka Sugizaki, Minomiya, all of Japan

[73] Assignee: Fuji Xerox Co., Ltd., Tokyo, Japan

[21] Appl. No.: 09/102,358

[22] Filed: Jun. 23, 1998

[30] Foreign Application Priority Data

Jun. 23, 1997 [JP] Japan ..... 9-166303
Oct. 16, 1997 [JP] Japan ..... 9-284114

[51] Int. Cl.[6] ..... G03G 9/097; G03G 13/22

[52] U.S. Cl. ..... 430/110; 430/111; 430/120

[58] Field of Search ..... 430/110, 111, 430/120

[56] References Cited

U.S. PATENT DOCUMENTS

| | | | |
|---|---|---|---|
| 5,298,356 | 3/1994 | Tyagi et al. | 430/110 |
| 5,346,723 | 9/1994 | Georges et al. | 430/110 |
| 5,346,790 | 9/1994 | Sacripante et al. | 430/109 |
| 5,486,445 | 1/1996 | Van Dusen et al. | 430/110 |
| 5,554,480 | 9/1996 | Patel et al. | 430/109 |
| 5,629,120 | 5/1997 | Serizawa et al. | 430/106.6 |

FOREIGN PATENT DOCUMENTS

| | | |
|---|---|---|
| A-4-257868 | 9/1992 | Japan . |
| A-7-199534 | 8/1995 | Japan . |
| A-7-244402 | 9/1995 | Japan . |
| B2-7-86699 | 9/1995 | Japan . |
| B2-7-86700 | 9/1995 | Japan . |
| B2-7-86701 | 9/1995 | Japan . |
| A-8-278658 | 10/1996 | Japan . |

*Primary Examiner*—Roland Martin
*Attorney, Agent, or Firm*—Oliff & Berridge, PLC

[57] ABSTRACT

The toner for developing an electrostatic charge image comprises a colorant, a binding resin and a resin copolymer of aliphatic hydrocarbon and aromatic hydrocarbon having 9 or more of carbon atoms. Preferably, the toner further comprises a wax. The endothermic peak of the wax at DSC is preferably from 70 to 100° C. The petroleum resin copolymer preferably has a ring and ball softening point of from 80 to 170° C., and the binding resin is preferably a polyester resin. The weight ratio of the aromatic hydrocarbon monomer and the aliphatic hydrocarbon monomer of the petroleum resin copolymer is preferably from 99:1 to 50:50.

22 Claims, No Drawings

TONER FOR DEVELOPING AN ELECTROSTATIC CHARGE IMAGE, DEVELOPING AGENT FOR ELECTROSTATIC CHARGE IMAGE AND IMAGE FORMATION METHOD

BACKGROUND OF THE INVENTION

1. Field of Invention

The present invention relates to a toner for developing an electrostatic charge image used for an electrophotographic method, an electrostatic recording method, electrostatic printing method etc., a developing agent for electrostatic charge image using the toner, and an image formation method using the developing agent.

2. Description of Related Art

As a fixing method for toner for developing an electrostatic charge image, a heating roll method is widely employed. In recent years, in order to speed up copying machines and to decrease energy consumption, using a heating roll having a smaller size in order to increase thermal efficiency, and fixing with a thin film have been proposed. However, since the heating roll is contacted with melted toner in the heating roll method, the toner is transferred to the surface of the roll, and re-transferred to a transferred material such as paper, polluting it. As a result, hot offset tends to occur.

A method of controlling viscoelasticity at the time of melting the toner by enlarging the molecular weight dispersion of a binding resin of the toner so as to avoid the occurrence of hot offset, and a method of decreasing adhesive force with a heating roll and film by adding a releasing agent such as wax in a toner, have been proposed. However, by these methods, the dispersion property of wax cannot be controlled sufficiently. When the releasing agent is a polyolefin wax, polyolefin is not easily dispersed since it only slightly dissolves in toner. As a result, a big domain of polyolefin is formed in a polyester resin, the toner is ground in the domain area at the time of grinding, and the polyolefin is easily exposed on the surface of the toner or liberated. In particular, when a magnetic developing agent is used, the polyolefin pollutes the toner carrying member (sleeve), providing for non-uniform toner carrying, decreasing the ability of the toner to provide charge and decreasing the image density. In order to maintain lower prices, in the case of, for example, small type machines using a magnetic one-component developing agent, the mechanism for cleaning a photosensitive member is often kept simple. Particularly in these less expensive machines, the liberated polyolefin wax pollutes the photosensitive body causing image faults (line). Thus the offset resistance of toner is not sufficient, and there are secondary faults such as with regard to powder flowability and a transfer of wax component to a photosensitive body and a carrier. These problems remain to be resolved.

A technique of satisfying low temperature fixing property, grindability and blocking resistance by using, as a binding resin for the toner, a polyester resin whose molecular weight dispersion is enlarged by incorporating cross-linking structure, is proposed in Japanese patent Publication No. 7-86699-B, No. 7-86700-B and No. 7-86701-B. However, even if a releasing agent such as a low molecular weight polypropylene is finely dispersed in a polyester resin in an effort to provide sufficient offset resistance, the compatibility of wax such as a low molecular weight polypropylene with a polyester resin having a relatively strong polarity is often insufficient. As a result, it is difficult to disperse the polypropylene in the polyester resin uniformly.

In order to resolve these problems, a technique of improving the wax dispersion property by improving compatibility of the polyester resin and the wax by using oxidative-type polyolefin wax having a polar group in the terminal position of a molecule is proposed in Japanese Patent Publication No. 7-244402-A. With this method, although the dispersion property of the wax is improved, the powder flowability and heat resistance of the toner are deteriorated. A technique of using aliphatic petroleum resin as a releasing agent is proposed in Japanese Patent Publication No. 7-199534-A. However, the same problems of deterioration of the powder flowability and heat resistance of the toner result. In addition, since the polyester resin itself is tough, grindability is limited, thus providing for lower productivity when a small size toner is needed to attain the high image quality of copied image.

In order to resolve the problems of grindability and heat resistance, the use of an aromatic petroleum resin is proposed in Japanese Patent Publication No. 4-257868-A, and the use of a hydrogenated petroleum resin is proposed in Japanese Patent Publication No. 8-278658-A. Although the use of these resins can improve grindability, they have no effect on improving the dispersion property of a releasing agent. In addition, these resins deteriorate the charging property of the toner.

SUMMARY OF THE INVENTION

The present invention provides a toner for developing an electrostatic charge image and a developing agent for electrostatic charge image which provide both grindability and heat resistance. The toner and developer of the present invention have a sufficiently low temperature fixing property and offset-resistance. In addition, the present invention provides a toner for developing an electrostatic charge image, a developing agent for electrostatic charge image and image formation method, which do not cause significant image faults due to filming of the wax to a photosensitive body and/or do not cause significant deterioration of charging property due to toner impaction on the carrier.

The toner for developing an electrostatic charge image comprises a colorant, a binding resin, a resin copolymer of an aliphatic hydrocarbon and an aromatic hydrocarbon having 9 or more of carbon atoms.

Further, in the developing agent for electrostatic charge image of the present invention having carrier and toner, the toner comprises a colorant, a binding resin and a resin copolymer of an aliphatic hydrocarbon and an aromatic hydrocarbon having 9 or more of carbon atoms.

Further, the image formation method of the present invention comprises the steps of forming an electrostatic latent image on an electrostatic latent image holding member, and developing the electrostatic latent image on the electrostatic latent image holding member by using a developing agent layer on a developing agent carrying member to form a toner image, the developing agent comprising a colorant, a binding resin and a resin copolymer of an aliphatic hydrocarbon and an aromatic hydrocarbon having 9 or more carbon atoms.

DETAILED DESCRIPTION OF PREFERRED EMBODIMENTS

The resin copolymer of aliphatic hydrocarbon and aromatic hydrocarbon having 9 or more carbon atoms functions as a dispersion auxiliary agent for the wax. Thus, use of the resin copolymer provides for improved wax dispersion in the resin, offset resistance, and/or grindability, while maintaining a low temperature fixing property. In addition, the decrease in image density due to inferiority of charging due to filming of wax to the developer carrying member and the occurrence of image fault due to filming to photosensitive member, are extremely improved. Further similar effects can be obtained in the case where a magnetic developing agent is added.

The resin copolymer of aliphatic hydrocarbon and aromatic hydrocarbon having 9 or more carbon atoms is synthesized by using a diolefin and a monoolefin as raw material. These products may be contained in a cracked petroleum fraction by-product from an ethylene plant manufacturing ethylene, propylene etc. by steam cracking of petroleums. The copolymer is preferably copolymerized from at least one or more aliphatic hydrocarbon monomers selected from the group comprising isoprene, piperylene, 2-methyl-butene-1, 2-methylbutene-2, and at least one or more aromatic hydrocarbon monomer selected from the group comprising vinyl toluene, α-methylstyrene, indene and isopropenyl toluene.

As the aromatic hydrocarbon monomer, monomer having high monomer purity is more preferable since it can restrain the coloring of resin and odor when heating. The purity of the aromatic hydrocarbon monomer is preferably 95% or higher, more preferably 98% or higher. The aromatic hydrocarbon monomer comprises a monomer having 9 or more carbon atoms. The resin copolymer obtained from the aromatic hydrocarbon monomer having 9 or more carbon atoms and the aliphatic hydrocarbon monomer has a higher compatibility with binding resins, such as polyester resin, compared with a resin copolymer obtained from an aromatic hydrocarbon monomer having fewer than 9 carbon atoms and an aliphatic hydrocarbon monomer.

In addition, the copolymer of aliphatic hydrocarbon and aromatic hydrocarbon having 9 or more carbon atoms preferably contains more aromatic hydrocarbon monomer than aliphatic hydrocarbon monomer. Such a ratio provides toner with improved grindability and heat resistance. However, if the amount of the aromatic hydrocarbon monomer is too much, the dispersion property of the releasing agent may be deteriorated. On the other hand, if the amount of the aliphatic hydrocarbon monomer is too much, the heat resistance and other properties may be decreased. Thus the weight ratio of the aromatic hydrocarbon monomer to the aliphatic hydrocarbon monomer is preferably from 99:1 to 50:50, more preferably from 98:2 to 60:40, and even more preferably from 98:2 to 90:10.

The resin copolymer of aliphatic hydrocarbon and aromatic hydrocarbon having 9 or more carbon atoms has characteristics of having a high glass transition point even when the molecular weight is lowered, of having a good balance of compatibility with various resins, elastomers and waxes, of having both heat resistance and grindability by melt-blending with binding resin, and of having little or no influence on the charging property of toner.

Further, since the resin copolymer of aliphatic hydrocarbon and aromatic hydrocarbon having 9 or more carbon atoms functions as a dispersion auxiliary agent of wax, by using the resin copolymer, a binding resin and a wax to avoid offset, the wax dispersion in the resin is extremely improved. As a result, offset resistance is extremely improved while the low temperature fixing property is maintained. In addition, the toner has good grindability, and the occurrence of image fault of copied material due to filming of wax to a photosensitive member and charging deterioration due to impaction of the toner to the carrier are improved.

The amount of the resin copolymer of aliphatic hydrocarbon and aromatic hydrocarbon having 9 or more carbon atoms used in the present invention is generally 2 to 50 parts by weight, more preferably 3 to 30 parts by weight, per 100 parts by weight of the toner binding resin. If the amount of the resin copolymer is less than 2 parts by weight, the resin copolymer may have little or no effect on the wax dispersion. If the amount exceeds 50 parts by weight, the toner tends to be excessively ground, the particle diameter of toner is therefore rendered small, fog may occur, image density may be lowered and there may be a decrease in developing property.

The ring and ball softening point of the resin copolymer of aliphatic hydrocarbon and aromatic hydrocarbon having 9 or more of carbon atoms used in the present invention is preferably from 80 to 170° C., more preferably from 100 to 150° C. If the softening point is less than 80° C., heat resistance may be deteriorated. If the softening point exceeds 170° C., the low temperature fixing property may be deteriorated.

The ring and ball softening point used in the present specification means a value determined in accordance with JIS K6863-1994 (a test method for determining softening point of hotmelt adhesive).

A known resin can be used as a binding resin in the present invention. For example, polyester resin, styrene resin, styrene-(meth)acrylic resin, styrene-butadiene resin, epoxy resin, polyurethane resin etc. may be used. The polyester resin is particularly preferable for lowering temperature fixing property.

The polyester resin used in the present invention may be synthesized by polycondensation using a polyol component and a polycarboxylic acid component. As the polyol component used, ethylene glycol, propylene glycol, 1,3-butane diol, 1,4-butane diol, 2,3-butane diol, diethylene glycol, triethylene glycol, 1,5-butane diol, 1,6-hexane diol, neopentyl glycol, cyclohexane dimethanol, hydrogenated bisphenol A, bisphenol-A ethylene oxide adduct, bisphenol-A propylene oxide adduct etc. may be exemplified. As the polyol component, maleic acid, fumaric acid, phthalic acid, isophthalic acid, terephthalic acid, succinic acid, dodecenylsuccinic acid, trimellitic acid, pyromellitic acid, cyclohexane tricarboxylic acid, 2,5,7-naphthalene tricarboxylic acid, 1,2,4-naphthalene tri-carboxylic acid, 1,2,5-hexane tricarboxylic acid, 1,3-di-carboxyl-2-methylene carboxypropane tetramethylene carboxylic acid and anhydride thereof may be used.

The softening point of the binding resin used in the present invention is preferably from 80 to 150° C., more preferably from 100 to 140° C. If the softening point of the binding resin is less than 80° C., the heat resistance may be deteriorated. If the softening point exceeds 150, the low temperature fixing property may be deteriorated. The glass transition point of the binding resin is preferably from 55 to 75° C. If the glass transition point is less than 55° C., the heat resistance may be deteriorated. If the glass transition point exceeds 75° C., the low temperature fixing property may be deteriorated.

The toner may also contain a wax (releasing agent). As the wax (releasing agent) used in the present invention, a low molecular weight polyethylene, a low molecular weight polypropylene, microcrystalline wax and aliphatic hydrocarbon wax such as paraffin wax, and aliphatic acid wax such as carnauba wax and montanic acid ester wax may be exemplified. Among them, a low molecular weight polyethylene and aliphatic hydrocarbon wax are preferable, and a low molecular weight polyethylene is more preferable. By using a low molecular weight polyethylene, a toner excellent in rubbing image strength after fixing can be obtained. In addition, the decrease of image quality such as pollution by abrasion and image stain, which occur by rubbing the surface of an image of a copy original by an automatic original paper feeder and paper feeding roller in a copying machine, can be avoided.

The wax (releasing agent) used in the present invention has an endothermic peak in DSC of preferably in the range from 70 to 100° C., more preferably in the range from 80 to 95° C. By using wax having an endothermic peak in the low temperature range, the releasing property in the low temperature range is improved, the occurrence of peeling nail clutch is controlled, and a wide fixable temperature range can be maintained without deteriorating the excellent low temperature fixing property of polyester resin. If the endothermic peak is less than 70° C., the heat resistance may be deteriorated, and if the endothermic peak exceeds 100° C., a sufficient releasing property at a low temperature range may not be obtained. The endothermic peak in DSC in the present specification means the temperature at the top of an endothermic peak by determining the increase of temperature at 10° C./min using DSC-50 (manufactured by Shimazu Seisakusho).

The amount of these releasing agents used is preferably from 0.1 to 20 parts by weight, more preferably 2 to 10 parts by weight, per 100 parts by weight of toner resin component. If the amount of the releasing agent used is less than 0.1 parts by weight, the releasing property of toner may be decreased, and if the amount exceeds 20 parts by weight, the charging property and heat resistance of toner may be decreased.

As the colorant of the present invention, a known colorant such as carbon black, phthalocyanine blue, quinacridone and bendizine yellow may be used.

A charge controlling agent and magnetic powders may be added to the toner of the present invention as needed. As the charge controlling agent, chrome azo dyes, iron azo dyes, aluminum azo dyes and salicylic acid metal complexes etc. may be used.

As the magnetic powders, a strong magnetic metal such as cobalt, iron and nickel, an alloy of a metal such as cobalt, iron, nickel, aluminum, lead, magnesium, zinc, manganese, a metal oxide such as $Fe_3O_4$, $\gamma$—$Fe_2O_3$, cobalt-added iron oxide, various ferrites such as MnZn ferrite, NiZn ferrite, magnetite and hematite are preferably used. In addition, magnetic powders in which the surfaces of which have been treated with a surface treating agent such as silane coupling agent or a titanate silane coupling agent or coated with a polymer may be preferably used.

The mixing ratio of the magnetic powders is preferably in the range from 30 to 70% (w/w), more preferably in the range from 35 to 65% (w/w), based on the total amount of the toner particles. When the magnetic powders are less than 30% (w/w), the restraint force of the toner may be decreased due to the magnetic forces of the toner carrying member and toner scattering and fog may occur. On the other hand, when the magnetic powders exceed 70% (w/w), image density may be decreased. Moreover, magnetic powders having an average particle diameter of about from 0.05 to 0.35 $\mu$m are preferably used in the view point of dispersion property of the binding resin.

An agent for improving flowability may be added to the surface of the toner particles of the present invention. As the agent for improving flowability, known inorganic particles such as silica particles, titanium oxide particles, alumina particles, whose surfaces are treated to be rendered hydrophobic, may be used.

The method of preparing the toner of the present invention, may comprise the steps of mixing a binding resin, a resin copolymer of aliphatic hydrocarbon and aromatic hydrocarbon having 9 or more carbon atoms, a releasing agent if desired, a colorant and a charge controlling agent if desired by a henschel mixer, melting and mixing them with a mixer such as an extruder, cooling the mixture, crushing it by a hammer mill, grinding it by a jet mill, classifying by a pneumatic classifier, and mixing it with an agent for improving flowability by a henschel mixer to obtain a toner.

The developing agent for electrostatic charge image of the present invention is a two-component developing agent comprising the above described toner and a carrier. The carrier is not specifically limited, and a known carrier such as resin-coated carrier can be preferably used. The resin-coated carrier is made by coating a resin on the surface of a core material. As the core material, a powder such as iron powder, ferrite powder and nickel powder may be exemplified. As the resin coated on the surface of the core material, fluorine resin, vinyl resin and silicone resin may be exemplified.

The developing agent of the present invention can optionally contain selected additives depending on the purposes. For example, the developing agent can contain a metal showing strong magnetic property such as irons, nickel, cobalt, an alloy or a compound containing such metals, a magnetic material, and/or a magnetizable material.

The image formation method of the present invention is characterized in using a developing agent for electrostatic charge image comprising a petroleum resin copolymer of aliphatic hydrocarbon and aromatic hydrocarbon having 9 or more of carbon atoms in the image formation method. The method comprises the steps of forming an electrostatic latent image on an electrostatic latent image holding member, and developing the electrostatic latent image on the electrostatic latent image holding member by using a developing agent layer on a developer carrying member to form a toner image. To fix the image, a fixing roller may be used. The surface of the fixing roller may be coated with a silicone oil such as dimethyl silicone, methyl phenyl silicone and amine denaturation silicone. In the image formation method, the above described advantages of the developing agent for electrostatic charge image can be demonstrated.

EXAMPLES

The present invention will be explained in detail with examples, hereinafter. However, the present invention is not limited by these examples.

The resin copolymers of aliphatic hydrocarbon and aromatic hydrocarbon used in the examples are as follows:

(A) $C_5$ petroleum fraction (isoprene)/$C_5$ petroleum fraction (piperylene)/isopropenyl toluene (weight ratio of the monomers is 1.5/1.5/97, and softening point is 125° C.).

(B) $C_5$ petroleum fraction (isoprene)/$C_5$ petroleum fraction (piperylene)/isopropenyl toluene having 98% purity (weight ratio of the monomers is 1.5/1.5/97, and softening point is 125° C.).

(C) $C_5$ petroleum fraction (isoprene)/isopropenyl toluene having 98% purity/indene having 98% of purity (weight ratio of the monomers is 3/50/47, and softening point is 150° C.).

(D) $C_5$ petroleum fraction (isoprene)/isopropenyl toluene having 98% purity/α-methylstyrene having 98% purity (weight ratio of the monomers is 5/50/45, and softening point is 125° C.).

(E) $C_5$ petroleum fraction (isoprene)/isopropenyl toluene having 98% purity/α-methylstyrene having 98% purity (weight ratio of the monomers is 15 30/35/35, softening point is 115° C.).

The softening point of the resin copolymer of aliphatic hydrocarbon and aromatic hydrocarbon is the ring and ball softening point.

The waxes (releasing agents) used in the examples are as follows:

Releasing agent A: polyethylene wax 1 (melting point 87.7° C.)
(number-average molecular weight 1500)

Releasing agent B: polyethylene wax 2 (melting point 82.1° C.)
(number-average molecular weight 1200)

Releasing agent C: polyethylene oxide wax (melting point 90.3° C.)
(number-average molecular weight 1000)

Releasing agent D: polypropylene oxide wax (melting point 138.8° C.)
(number-average molecular weight 3500)

Releasing agent E: polypropylene wax (melting point 142.6° C.)
(number-average molecular weight 3000)

Releasing agent F: Fischer Tropsch wax (melting point 85.0° C.)
(number-average molecular weight 2000)

Releasing agent G: carnauba wax (softening point 83.5° C.)
(number-average molecular weight 2000)

Releasing agent H: paraffin wax (softening point 80.0° C.)
(number-average molecular weight 1000)

The melting point corresponds to the endothermic peak in DSC.

Example 1

| | |
|---|---|
| Polyester resin (bisphenol A ethylene oxide adduct/bisphenol A propylene oxide adduct/terephthalic acid/fumaric acid condensate, weight-average molecular weight 6000, softening point 100° C., glass-transition point 58° C., acid value 15) | 84 parts by weight |
| Petroleum resin copolymer of aliphatic hydrocarbon-aromatic hydrocarbon (A) | 10 parts by weight |
| Carbon black (BPL, manufactured by Cabot) | 6 parts by weight |

The above mixture is melted and mixed, then rolled and cooled. The mixture is crushed by a hammer mill, ground by a jet mill and classified by a pneumatic classifier to obtain toner mother particles having a volume-average particle diameter of 9.0 μm . 1.0 parts by weight of titanium oxide and 0.3 parts by weight of hydrophobic silica are mixed with 100 parts by weight of the toner mother particles by a henschel mixer to obtain toner particles.

6 parts by weight of the toner particles and 100 parts by weight of a carrier of 50 μm having a ferrite core coated with 2% styrene/acrylic resin, are mixed to obtain a developing agent.

Example 2

Toner particles and a developing agent are obtained in the same manner as described in Example 1 except that the petroleum resin copolymer of aliphatic hydrocarbon and aromatic hydrocarbon (B) is used instead of the petroleum resin copolymer of aliphatic hydrocarbon and aromatic hydrocarbon (A).

Example 3

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Petroleum resin copolymer of aliphatic hydrocarbon and aromatic hydrocarbon (A) | 10 parts by weight |
| Releasing agent E | 5 parts by weight |
| Carbon black (BPL, manufactured by Cabot) | 6 parts by weight |

The above mixture is processed in the same manner as described in Example 1 to obtain toner particles and a developing agent.

Example 4

| | |
|---|---|
| Polyester resin (bisphenol A ethylene oxide adduct/bispheno1 A propylene oxide adduct/terephtalic acid/fumaric acid/trimellitic acid/dodecenylsuccinic acid condensate, weight-average molecular weight 30000, softening point 130° C., glass transition point 62° C., acid value 15) | 86 parts by weight |
| Petroleum resin copolymer of aliphatic hydrocarbon and aromatic hydrocarbon (B) | 3 parts by weight |
| Releasing agent E | 5 parts by weight |
| Carbon black (BPL, manufactured by Cabot) | 6 parts by weight |

The above mixture is processed in the same manner as described in Example 1 to obtain toner particles and a developing agent.

Example 5

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Petroleum resin copolymer of aliphatic hydrocarbon and aromatic hydrocarbon (B) | 10 parts by weight |
| Releasing agent E | 5 parts by weight |
| Carbon black (BPL, manufactured by Cabot) | 6 parts by weight |

The above mixture is processed in the same manner as described in Example 1 to obtain toner particles and a developing agent.

Example 6

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 69 parts by weight |
| Petroleum resin copolymer of aliphatic hydrocarbon and aromatic hydrocarbon (B) | 20 parts by weight |
| Releasing agent E | 5 parts by weight |
| Carbon black (BPL, manufactured by Cabot) | 6 parts by weight |

The above mixture is processed in the same manner as described in Example 1 to obtain toner particles and a developing agent.

Example 7

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Petroleum resin copolymer of aliphatic hydrocarbon and aromatic hydrocarbon (C) | 10 parts by weight |
| Releasing agent F | 5 parts by weight |
| Carbon black (BPL, manufactured by Cabot) | 6 parts by weight |

The above mixture is processed in the same manner as described in Example 1 to obtain toner particles and a developing agent.

Example 8

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Petroleum resin copolymer of aliphatic hydrocarbon and aromatic hydrocarbon (D) | 10 parts by weight |
| Releasing agent E | 5 parts by weight |
| Carbon black (BPL, manufactured by Cabot) | 6 parts by weight |

The above mixture is processed in the same manner as described in Example 1 to obtain toner particles and a developing agent.

Example 9

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Petroleum resin copolymer of aliphatic hydrocarbon and aromatic hydrocarbon (E) | 10 parts by weight |
| Releasing agent E | 5 parts by weight |
| Carbon black (BPL, manufactured by Cabot) | 6 parts by weight |

The above mixture is processed in the same manner as described in Example 1 to obtain toner particles and a developing agent.

Example 10

Toner particles and a developing agent are obtained in the same manner as described in Example 5 except that a copolymer of styrene and butyl acrylate (80/20 w/w, number-average molecular weight 3500, weight-average molecular weight 300000) is used instead of the polyester resin.

Comparative Example 1

| | |
|---|---|
| Polyester resin (bisphenol A ethylene oxide adduct/bisphenol A propylene oxide adduct/terephtalic acid/fumaric acid condensate, weight-average molecular weight 6000, softening point 100° C., glass transition point 58° C., acid value 15) | 84 parts by weight |
| Aliphatic hydrocarbon petroleum resin ($C_5$ petroleum fraction: isoprene/piperylene = 50/50 w/w) | 10 parts by weight |
| Carbon black (BPL, manufactured by Cabot) | 6 parts by weight |

The above mixture is processed in the same manner as described in Example 1 to obtain toner particles and a developing agent.

Comparative Example 2

| | |
|---|---|
| Polyester resin (bisphenol A ethylene oxide adduct/bisphenol A propylene oxide adduct/terephtalic acid/fumaric acid condensate, weight-average molecular weight 6000, softening point 100° C., glass transition point 58° C., acid value 15) | 84 parts by weight |
| Aromatic hydrocarbon petroleum resin ($C_9$ petroleum fraction: α-methylstyrene) | 10 parts by weight |
| Carbon black (BPL, manufactured by Cabot) | 6 parts by weight |

The above mixture is processed in the same manner as described in Example 1 to obtain toner particles and a developing agent.

Comparative Example 3

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 89 parts by weight |
| Releasing agent E | 5 parts by weight |
| Carbon black (BPL, manufactured by Cabot) | 6 parts by weight |

The above mixture is processed in the same manner as described in Example 1 to obtain toner particles and a developing agent.

Comparative Example 4

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 89 parts by weight |
| Releasing agent D | 5 parts by weight |
| Carbon black (BPL, manufactured by Cabot) | 6 parts by weight |

The above mixture is processed in the same manner as described in Example 1 to obtain toner particles and a developing agent.

Comparative Example 5

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Aliphatic hydrocarbon petroleum resin ($C_5$ petroleum fraction: isoprene/piperylene = 50/50 w/w) | 10 parts by weight |
| Releasing agent E | 5 parts by weight |
| Carbon black (BPL, manufactured by Cabot) | 6 parts by weight |

The above mixture is processed in the same manner as described in Example 1 to obtain toner particles and a developing agent.

Comparative Example 6

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Aromatic hydrocarbon petroleum resin ($C_9$ petroleum fraction: α-methyl styrene) | 10 parts by weight |
| Releasing agent E | 5 parts by weight |
| Carbon black (BPL, manufactured by Cabot) | 6 parts by weight |

The above mixture is processed in the same manner as described in Example 1 to obtain toner particles and a developing agent.

Comparative Example 7

Toner particles and a developing agent are obtained in the same manner as described in Example 3 except that a copolymer of styrene and butyl acrylate (85/15 w/w, weight-average molecular weight 300000) is used instead of the petroleum resin copolymer of aliphatic hydrocarbon and aromatic hydrocarbon (A).

For each of the toner particles and the developing agents thus obtained in Examples 1 to 11 and Comparative Examples 1 to 7, the dispersion property of the releasing agent, flowability of the toner, heat resistance of the toner, grindability of the toner, filming to the photosensitive body, image density and fixing property are evaluated.

<Dispersion property of toner>

Toner sections are observed with a permeation type electron microscope. The toner having no problem in practical use has a dispersion property of 0.5 μm or less.

<Flowability of toner>

The amount of toner which falls from a toner cartridge per one minute under a continuous operation with a V500 Modifier, manufactured by Fuji Xerox Co., Ltd., is determined. The toner having no problems in practical used has an amount of about 15 g or more.

<Heat resistance of toner>

The amount (%) of toner remaining on an open mesh of 106 μm after being left for 24 hours under an atmosphere of 50° C. and 50% RH, is determined. The toner having no problems in practical use has an amount of 5% or less.

<Index of grindability of toner>

When the mixed and crushed toner is ground by a jet mill, the feed rate to provide a volume-average particle diameter of 9.0 μm (Coule counter TA-II type, aperture diameter: 100 μm) is calculated. The feed rate of the toner of Example 1 is 1.0, and the feed of the other toners is divided by the value of the feed of that of Example 1. The larger the index of grindability of a toner, the easier the grinding of the toner. The toner having no problem in practical use has an index of 0.8 or more.

<Filming to photosensitive body>

After copying 100,000 sheets with V 500 Modifier, manufactured by Fuji Xerox, image faults due to filming to the photosensitive body is graded. (G5: very bad to G1: excellent)

<Lowest image density among 100,000 sheets>

The decrease of image density due to variation of charging (charge up) of a developing agent is evaluated by a Macbeth densitometer while 100,000 sheets are copied by a V 500 Modifier, manufactured by Fuji Xerox. The toner having no problem in practical use has the lowest image density of about 1.20 or more.

<Odor at the time of fixing>

The odor that occurs when the toner is passed through a fixing apparatus is evaluated organoleptically.

<Lowest fixing temperature>

A test is carried out by varying the fixing temperature with a V 500 Modifier, manufactured by Fuji Xerox. Folding a solid image into two, the level is graded visually. The lowest temperature to be an acceptable level is determined. The temperature having no problem in practical use is about 135° C. or less.

<Offset temperature>

The fixing temperature is changed by a V 500 Modifier manufactured by Fuji Xerox and a test is carried out. The offset level is graded visually.

Silicone oil is supplied to the fixing roll only in Examples 1 and 2 and Comparative Examples 1 and 2.

The results are shown in Tables 1 and 2 below. In Tables 1 and 2, as well as Tables 3–6 below, O represents excellent; Δ represents good; X represents poor; and XX represents very poor. In the overall evaluation, ⓪ is included to signify those examples that are the most excellent.

TABLE 1

| | Dispersion of Releasing Agent in Toner | | Toner Flowability | | Heat-Resistance of Toner | | Toner Grindability Index | | Photosensitive Body Filming | |
|---|---|---|---|---|---|---|---|---|---|---|
| No. | Dispersion diameter | Evaluation | Flowability | Evaluation | Heat-resistance | Evaluation | Grindability Index | Evaluation | Filming | Evaluation |
| Example 1 | — | — | 24 g | ○ | 0.2 | ○ | 1 | ○ | G1 | ○ |
| Example 2 | — | — | 24 g | ○ | 0.2 | ○ | 1 | ○ | G1 | ○ |
| Example 3 | 0.04 μm | ○ | 22 g | ○ | 0.3 | ○ | 1.2 | ○ | G1 | ○ |
| Example 4 | 0.49 μm | ○ | 19 g | ○ | 0.5 | ○ | 0.9 | ○ | G1 | ○ |
| Example 5 | 0.39 μm | ○ | 22 g | ○ | 0.3 | ○ | 1.2 | ○ | G1 | ○ |
| Example 6 | 0.33 μm | ○ | 24 g | ○ | 0.2 | ○ | 1.4 | ○ | G1 | ○ |
| Example 7 | 0.40 μm | ○ | 23 g | ○ | 0.2 | ○ | 1.1 | ○ | G1 | ○ |
| Example 8 | 0.41 μm | ○ | 22 g | ○ | 0.3 | ○ | 1.2 | ○ | G1 | ○ |
| Example 9 | 0.44 μm | ○ | 19 g | ○ | 0.4 | ○ | 1.2 | ○ | G1 | ○ |
| Example 10 | 0.37 μm | ○ | 23 g | ○ | 0.3 | ○ | 1.4 | ○ | G1 | ○ |
| Comparative Example 1 | — | — | 11 g | X | 10.3 | X | 0.6 | X | G1 | ○ |
| Comparative Example 2 | — | — | 20 g | ○ | 0.3 | ○ | 0.9 | ○ | G1 | ○ |
| Comparative Example 3 | 3.2 μm | XX | 7 g | X | 20.1 | X | 0.4 | X | G4 | XX |
| Comparative Example 4 | 0.68 μm | X | 11 g | X | 31.3 | X | 0.36 | X | G2 | X |
| Comparative Example 5 | 1.2 μm | X | 8 g | X | 35.8 | X | 1 | ○ | G3 | X |
| Comparative Example 6 | 1.4 μm | X | 11 g | X | 28.7 | X | 0.8 | Δ | G3 | X |
| Comparative Example 7 | 1.8 μm | X | 10 g | X | 30.5 | X | 0.9 | ○ | G3 | X |

TABLE 2

| No. | Lowest Image Density Among 100,000 Sheets | | Odor Occurred at the Time of Fixing | | Lowest Fixing Temperature | | Offset Temperature | | Overall |
|---|---|---|---|---|---|---|---|---|---|
| | Density | Evaluation | Odor Occurred | Evaluation | Temperature | Evaluation | Temperature | Evaluation | Evaluation |
| Example 1 | 1.35 | ○ | a little | Δ | 110° C. | ○ | no problem in practical at 220° C. | ○ | ○ |
| Example 2 | 1.36 | ○ | none | ○ | 110° C. | ○ | no problem in practical use at 220° C. | ○ | ◎ |
| Example 3 | 1.34 | ○ | none | ○ | 130° C. | ○ | does not occur up to ~250° C. | ○ | ◎ |
| Example 4 | 1.35 | ○ | none | ○ | 130° C. | ○ | does not occur up to ~250° C. | ○ | ◎ |
| Example 5 | 1.34 | ○ | none | ○ | 130° C. | ○ | does not occur up to ~250° C. | ○ | ◎ |
| Example 6 | 1.34 | ○ | none | ○ | 133° C. | ○ | does not occur up to ~250° C. | ○ | ◎ |
| Example 7 | 1.35 | ○ | none | ○ | 133° C. | ○ | does not occur up to ~250° C. | ○ | ◎ |
| Example 8 | 1.33 | ○ | none | ○ | 130° C. | ○ | does not occur up to ~250° C. | ○ | ◎ |
| Example 9 | 1.35 | ○ | none | ○ | 128° C. | ○ | does not occur up to ~250° C. | ○ | ◎ |
| Example 10 | 1.35 | ○ | none | ○ | 136° C. | Δ | does not occur up to ~250° C. | ○ | ○ |
| Comparative Example 1 | 1.30 | ○ | none | ○ | 110° C. | ○ | no problem in practical use at 220° C. | ○ | X |
| Comparative Example 2 | 1.30 | ○ | a little | Δ | 140° C. | X | no problem in practical use at 220° C. | ○ | X |
| Comparative Example 3 | 0.87 | X | none | ○ | 130° C. | ○ | does not occur up to ~250° C. | ○ | X |
| Comparative Example 4 | 0.97 | X | none | ○ | 130° C. | ○ | does not occur up to ~250° C. | ○ | X |
| Comparative Example 5 | 1.01 | X | none | ○ | 130° C. | ○ | does not occur up to ~250° C. | ○ | X |
| Comparative Example 6 | 1.03 | X | a little | Δ | 130° C. | ○ | does not occur up to ~250° C. | ○ | X |
| Comparative Example 7 | 1.02 | X | none | ○ | 140° C. | X | does not occur up to ~250° C. | ○ | X |

The results in Tables 1 and 2 demonstrate that the above-described properties are all excellent in each of Examples 1 to 10. In particular, it is shown that odor does not occur at the time of fixing in Examples 2 and 4 to 9 in which aromatic hydrocarbon monomers having 9 or more carbons having high purities are used. In addition, the lowest fixing properties are achieved in Examples 1 to 9 in which polyester resins are used as a binding resin.

Example 11

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Petroleum resin copolymer of aliphatic hydrocarbon and aromatic hydrocarbon (A) | 10 parts by weight |
| Releasing Agent A | 5 parts by weight |
| Carbon black (BPL, manufactured by Cabot) | 6 parts by weight |

The above mixture is processed in the same manner as described in Example 1 to obtain toner particles and a developing agent.

Example 12

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Petroleum resin copolymer of aliphatic hydrocarbon and aromatic hydrocarbon (B) | 10 parts by weight |
| Releasing Agent A | 5 parts by weight |
| Carbon black (BPL, manufactured by Cabot) | 6 parts by weight |

The above mixture is processed in the same manner as described in Example 1 to obtain toner particles and a developing agent.

Example 13

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 69 parts by weight |
| Petroleum resin copolymer of aliphatic hydrocarbon and aromatic hydrocarbon (B) | 20 parts by weight |
| Releasing agent A | 5 parts by weight |
| Carbon black (BPL, manufacturcd by Cabot) | 6 parts by weight |

The above mixture is processed in the same manner as described in Example 1 to obtain toner particles and a developing agent.

Example 14

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 89 parts by weight |
| Petroleum resin copolymer of aliphatic hydrocarbon and aromatic hydrocarbon (B) | 3 parts by weight |
| Releasing agent A | 5 parts by weight |
| Carbon black (BPL, manufactured by Cabot) | 6 parts by weight |

The above mixture is processed in the same manner as described in Example 1 to obtain toner particles and a developing agent.

Example 15

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Petroleum resin copolymer of aliphatic hydrocarbon and aromatic hydrocarbon (C) | 10 parts by weight |
| Releasing agent A | 5 parts by weight |
| Carbon black (BPL, manufactured by Cabot) | 6 parts by weight |

The above mixture is processed in the same manner as described in Example 1 to obtain toner particles and a developing agent.

Example 16

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular 30000, softening point 130° C., glass tranisition point 62° C., acid value 15) | 79 parts by weight |
| Petroleum resin copolymer of aliphatic hydrocarbon and aromatic hydrocarbon (D) | 10 parts by weight |
| Releasing agent A | 5 parts by weight |
| Carbon black (BPL, manufactured by Cabot) | 5 parts by weight |

The above mixture is processed in the same manner as described in Example 1 to obtain toner particles and a developing agent.

Example 17

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Petroleum resin copolymer of aliphatic hydrocarbon and aromatic hydrocarbon (E) | 10 parts by weight |
| Releasing agent A | 5 parts by weight |
| Carbon black (BPL, manufactured by Cabot) | 6 parts by weight |

The above mixture is processed in the same manner as described in Example 1 to obtain toner particles and a developing agent.

Example 18

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average moleclar weight 30000, softening point 130° C., glass transition point 62° C., acid value 15) | 79 parts by weight |
| Petroleum resin copolymer of aliphatic hydrocarbon and aromatic hydrocarbon (B) | 10 parts by weight |
| Releasing agent B | 5 parts by weight |
| Carbon black (BPL, manufactured by Cabot) | 6 parts by weight |

The above mixture is processed in the same manner as described in Example 1 to obtain toner particles and a developing agent.

Example 19

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Petroleum resin copolymer of aliphatic hydrocarbon and aromatic hydrocarbon (B) | 10 parts by weight |
| Releasing agent F | 5 parts by weight |
| Carbon black (BPL, manufactured by Cabot) | 6 parts by weight |

The above mixture is processed in the same manner as described in Example 1 to obtain toner particles and a developing agent.

Example 20

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Petroleum resin copolymer of alphatic hydrocarbon and aromatic hydrocarbon (B) | 10 parts by weight |
| Releasing agent G | 5 parts by weight |
| Carbon black (BPL, manufactured by Cabot) | 6 parts by weight |

The above mixture is processed in the same manner as described in Example 1 to obtain toner particles and a developing agent.

Example 21

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Petroleum resin copolymer of aliphatic hydrocarbon and aromatic hydrocarbon (B) | 10 parts by weight |
| Releasing agent H | 5 parts by weight |
| Carbon black (BPL, manufactured by Cabot) | 6 parts by weight |

The above mixture is processed in the same manner as described in Example 1 to obtain toner particles and a developing agent.

Comparative Example 8

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 89 parts by weight |
| Releasing agent A | 5 parts by weight |
| Carbon black (BPL, manufactured by Cabot) | 6 parts by weight |

The above mixture is processed in the same manner as described in Example 1 to obtain toner particles and a developing agent.

Comparative Example 9

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Aliphatic hydrocarbon petroleum resin ($C_5$ petroleum fraction: isoprene/piperylene = 50/50 w/w) | 10 parts by weight |
| Releasing agent A | 5 parts by weight |
| Carbon black (BPL, manufactured by Cabot) | 6 parts by weight |

The above mixture is processed in the same manner as described in Example 1 to obtain toner particles and a developing agent.

Comparative Example 10

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Aromatic hydrocarbon petroleum resin ($C_9$ petroleum fraction: α-methyl styrene) | 10 parts by weight |
| Releasing agent A | 5 parts by weight |
| Carbon black (BPL, manufactured by Cabot) | 6 parts by weight |

The above mixture is processed in the same manner as described in Example 1 to obtain toner particles and a developing agent.

Comparative Example 11

| | |
|---|---|
| Polyester resin (bisphenol A ethylene oxide adduct/bisphenol A propylene oxide adduct/terephtalic acid/fumaric acid/trimellitic acid/dodecenylsuccinic acid condensate, weight-average molecular weight 30000, softening point 130° C., glass transition point 62° C., acid value 15) | 79 parts by weight |
| Aliphatic hydrocarbon petroleum resin ($C_5$ petroleum fraction: isoprene/piperylene = 50/50 w/w) | 10 parts by weight |
| Releasing agent C | 5 parts by weight |
| Carbon black (BPL, manufactured by Cabot) | 6 parts by weight |

The above mixture is processed in the same manner as described in Example 1 to obtain toner particles and a developing agent.

For each of the toner particles and developing agents thus obtained in Examples 11 to 21 and Comparative Examples 8 to 11, the same evaluations as Examples 1 to 10 and Comparative Examples 1 to 7, and the evaluations of peeling nail scratch-disappearing temperature and rubbing image density as described below, are performed.

<Peeling nail scratch-disappearing temperature>

Fixing is carried out by varying fixing temperature with a V 500 Modifier manufactured by Fuji Xerox. The lowest temperature to about 120° C. at which there is no practical problem with peeling nail scratch occurring in the point of a solid black image is determined. As long as the lowest temperature at which peeling nail scratch occurs is about 135° C. or less, there is no problem in practical use.

<Rubbing image density>

The determination is carried out using an automatic original paper feeder of a V 500 Modifier manufactured by Fuji Xerox. Five original papers are set in the machine and fed and the grade of the pollution of the original after a second sheet is visually determined. (G5: very bad to G0: excellent)

The results are shown in Tables 3 and 4 below.

TABLE 3

| | Dispersion of Releasing Agent in Toner | | Toner Flowability | | Heat-Resistance of Toner | | Toner Grindability Index | | Photosensitive Body Filming | |
|---|---|---|---|---|---|---|---|---|---|---|
| No. | Dispersion diameter | Evaluation | Flowability | Evaluation | Heat-resistance | Evaluation | Grindability Index | Evaluation | Filming | Evaluation |
| Example 11 | 0.22 μm | ○ | 20 g | ○ | 0.5 | ○ | 1.0 | ○ | G1 | ○ |
| Example 12 | 0.26 μm | ○ | 20 g | ○ | 0.5 | ○ | 1.0 | ○ | G1 | ○ |
| Example 13 | 0.21 μm | ○ | 22 g | ○ | 0.4 | ○ | 1.2 | ○ | G1 | ○ |
| Example 14 | 0.40 μm | ○ | 17 g | ○ | 0.8 | ○ | 0.8 | ○ | G1 | ○ |
| Example 15 | 0.27 μm | ○ | 21 g | ○ | 0.3 | ○ | 0.9 | ○ | G1 | ○ |
| Example 16 | 0.30 μm | ○ | 20 g | ○ | 0.5 | ○ | 1.0 | ○ | G1 | ○ |
| Example 17 | 0.27 μm | ○ | 18 g | ○ | 0.7 | ○ | 1.0 | ○ | G1 | ○ |
| Example 18 | 0.30 μm | ○ | 18 g | ○ | 0.7 | ○ | 1.0 | ○ | G1 | ○ |
| Example 19 | 0.31 μm | ○ | 18 g | ○ | 0.7 | ○ | 1.0 | ○ | G1 | ○ |
| Example 20 | 0.11 μm | ○ | 17 g | ○ | 0.7 | ○ | 1.0 | ○ | G1 | ○ |
| Example 21 | 0.40 μm | ○ | 18 g | ○ | 0.4 | ○ | 1.0 | ○ | G1 | ○ |
| Comparative Example 8 | 2.1 μm | X | 7 g | X | 32.4 | X | 0.4 | X | G5 | XX |
| Comparative Example 9 | 0.52 μm | Δ | 8 g | X | 30.8 | X | 0.5 | X | G3 | X |
| Comparative Example 10 | 1.42 μm | X | 11 g | X | 29.6 | X | 0.5 | ○ | G3 | X |
| Comparative Example 11 | 1.20 μm | X | 11 g | X | 31.3 | X | 0.3 | X | G2 | Δ |

TABLE 4

| No. | Lowest Image Density | | Odor Occurs at the Time of Fixing | | Lowest Fixing Temperature | | Offset Temperature | | Peeling Nail Scratch Dispersing Temperature | | Rubbing Image Density | | Overall |
|---|---|---|---|---|---|---|---|---|---|---|---|---|---|
| | Temperature | Evaluation | Odor Occurs | Evaluation | Temperature | Evaluation | Temperature | Evaluation | Temperature | Evaluation | Density | Evaluation | Evaluation |
| Example 11 | 1.33 | ○ | a little | Δ | 130° C. | ○ | does not occur up to ~250° C. | ○ | does not occur | ○ | G0 | ○ | ○ |
| Example 12 | 1.34 | ○ | none | ○ | 130° C. | ○ | does not occur up to ~250° C. | ○ | does not occur | ○ | G0 | ○ | ◎ |
| Example 13 | 1.33 | ○ | none | ○ | 133° C. | ○ | does not occur up to ~250° C. | ○ | does not occur | ○ | G1 | ○ | ◎ |
| Example 14 | 1.28 | ○ | none | ○ | 130° C. | ○ | does not occur up to ~250° C. | ○ | does not occur | ○ | G0 | ○ | ◎ |
| Example 15 | 1.34 | ○ | none | ○ | 133° C. | ○ | does not occur up to ~250° C. | ○ | does not occur | ○ | G0 | ○ | ◎ |
| Example 16 | 1.35 | ○ | none | ○ | 130° C. | ○ | does not occur up to ~250° C. | ○ | does not occur | ○ | G0 | ○ | ◎ |
| Example 17 | 1.31 | ○ | none | ○ | 128° C. | ○ | does not occur up to ~250° C. | ○ | does not occur | ○ | G0 | ○ | ◎ |
| Example 18 | 1.30 | ○ | none | ○ | 130° C. | ○ | does not occur up to ~250° C. | ○ | does not occur | ○ | G0 | ○ | ◎ |
| Example 19 | 1.31 | ○ | none | ○ | 130° C. | ○ | does not occur up to ~250° C. | ○ | does not occur | ○ | G2 | Δ | ○ |
| Example 20 | 1.30 | ○ | a little | Δ | 128° C. | ○ | does not occur up to ~250° C. | ○ | does not occur | ○ | G2 | Δ | ○ |
| Example 21 | 1.31 | ○ | none | ○ | 130° C. | ○ | does not occur up to ~250° C. | ○ | does not occur | ○ | G2 | Δ | ○ |
| Comparative Example 8 | 0.80 | X | none | ○ | 130° C. | ○ | does not occur up to ~248° C. | ○ | does not occur | ○ | G0 | ○ | X |
| Comparative Example 9 | 0.99 | X | none | ○ | 130° C. | ○ | does not occur up to ~249° C. | ○ | does not occur | ○ | G0 | ○ | X |
| Comparative Example 10 | 1.00 | X | a little | Δ | 130° C. | ○ | does not occur up to ~250° C. | ○ | does not occur | ○ | G0 | ○ | X |
| Comparative Example 11 | 0.97 | X | none | ○ | 130° C. | ○ | occurs at ~230° C. | Δ | 138° C. | X | G2 | Δ | X |

The results shown in Tables 3 and 4 demonstrate that all of determined properties of the all toners of Examples 11 to 21 are excellent. In particular, significant odor does not occur at the time of fixing especially when an aromatic hydrocarbon monomer having 9 or more carbons having high purity is used in the resin copolymer, and the rubbing image density is particularly excellent when polyethylene is used as the releasing agent.

Example 22

| | |
|---|---|
| Polyester resin (bisphenol A ethylene oxide adduct/bisphenol A propylene oxide adduct/maleic anhydride/terephthalic acid condensate, weight-average molecular weight 20000, softening point 120° C., glass transition point 65° C., acid value 15) 62° C., acid value 15) | 39.5 parts by weight |
| Petroleum resin copolymer of aliphatic hydrocarbon and aromatic hydrocarbon (A) | 6.0 parts by weight |
| Releasing agent E | 3.0 parts by weight |
| Magnetite (particle diameter: 0.2 μm) | 50.0 parts by weight |
| Negative chargeable charge controlling agent (Fe-containing azo dye) | 1.5 parts by weight |

The above materials are mixed to form a powder by a henschel mixer and are mixed thermally with an extruder set at 140° C. After cooling, these materials are crushed and ground so as to obtain particles having a 50% volume particle diameter $D_{50}$ of 6.6 μm. The particles are classified to obtain classified product having $D_{50}$=7.2 μm, 5 μm or less: 22%. 0.5 parts by weight of magnetic powders having an average particle diameter of 0.42 μm, wherein 5% of the particles have an average particle diameter of 0.2 μm or less and 1% of the particles have an average particle diameter of 1.0 μm or more, and 1.0 parts by weight of silica treated with silicone oil having a particle diameter of 12 nm are added externally by a henschel mixer to 100 parts by weight of the classified toner so as to obtain toner particles.

6 parts by weight of the toner particles and 100 parts by weight of 50 μm carrier having a ferrite core coated with styrene/acrylic resin are mixed to obtain a developing agent.

Example 23

| | |
|---|---|
| Polyester resin (bisphenol A ethylene oxide adduct/bisphenol A propylene oxide adduct/maleic anhydride/terephthalic acid condensate, weight-average molecular weight 20000, softening point 120° C., glass transition point 65° C., acid value 15) | 43.5 parts by weight |
| Petroleum resin copolymer of aliphatic hydrocarbon and aromatic hydrocarbon (A) | 2.0 parts by weight |
| Releasing agent E | 3.0 parts by weight |
| Magnetite particle diameter: 0.2 μm) | 50.0 parts by weight |
| Negative chargeable charge controlling agent (Fe-containing azo dye) | 1.5 parts by weight |

The mixture is processed in the same manner as described in Example 22 to obtain toner particles and a developing agent.

Example 24

| | |
|---|---|
| Polyester resin (bisphenol A ethylene oxide adduct/bisphenol A propylene oxide adduct/maleic anhydride/terephthalic acid condensate, weight-average molecular weight 20000, softening point 120° C., glass transition point 65° C., acid value 15) | 30.5 parts by weight |
| Petroleum resin copolymer of aliphatic hydrocarbon and aromatic hydrocarbon (A) | 15.0 parts by weight |
| Releasing agent E | 3.0 parts by weight |
| Magnetite particle diameter; 0.2 μm) | 50.0 parts by weight |
| Negative chargeable charge controlling agent (Fe-containing azo dye) | 1.5 parts by weight |

The mixture is processed in the same manner as described in Example 22 to obtain toner particles and a developing agent.

Example 25

| | |
|---|---|
| Polyester resin (bisphenol A ethylene oxide adduct/bisphenol A propylene oxide adduct/maleic anhydride/terephthalic acid condensate, weight-average molecular weight 20000, softening point 120° C., glass transition point 65° C., acid value 15) | 39.5 parts by weight |
| Petroleum resin copolymer of aliphatic hydrocarbon and aromatic hydrocarbon (B) | 6.0 parts by weight |
| Releasing agent E | 3.0 parts by weight |
| Magnetite particle diameter: 0.2 μm) | 50.0 parts by weight |
| Negative chargeable charge controlling agent (Fe-containing azo dye) | 1.5 parts by weight |

The mixture is processed in the same manner as described in Example 22 to obtain toner particles and a developing agent.

Example 26

| | |
|---|---|
| Polyester resin bisphenol A ethylene oxide adduct/bisphenol A propylene oxide adduct/maleic anhydride/terephthalic acid condensate, weight-average molecular weight 20000, softening point 120° C., glass transition point 65° C., acid value 15) | 39.5 parts by weight |
| Petroleum resin copolymer of aliphatic hydrocarbon and aromatic hydrocarbon (C) | 6.0 parts by weight |
| Releasing agent E | 3.0 parts by weight |
| Magnetite particle diameter: 0.2 μm) | 50.0 parts by weight |
| Negative chargeable charge controlling agent (Fe-containing azo dye) | 1.5 parts by weight |

The mixture is processed in the same manner as described in Example 22 to obtain toner particles and a developing agent.

Example 27

| | |
|---|---|
| Polyester resin (bisphenol A ethylene oxide adduct/bisphenol A propylene oxide adduct/maleic anhydride/terephthalic acid condensate, weight-average molecular weight 20000, softening point 120° C., glass transition point 65° C., acid value 15) | 39.5 parts by weight |
| Petroleum resin copolymer of aliphatic hydrocarbon and aromatic hydrocarbon (D) | 6.0 parts by weight |
| Releasing agent E | 3.0 parts by weight |
| Magnetite (particle diameter: 0.2 μm) | 50.0 parts by weight |
| Negative chargeable charge controlling agent (Fe-containing azo dye) | 1.5 parts by weight |

The mixture is processed in the same manner as described in Example 22 to obtain toner particles and a developing agent.

Example 28

| | |
|---|---|
| Polyester resin (bisphenol A ethylene oxide adduct/bisphenol A propylene oxide adduct/maleic anhydride/terephthalic acid condensate, weight-average molecular weight 20000, softening point 120° C., glass transition point 65° C., acid value 15) | 39.5 parts by weight |
| Petroleum resin copolymer of aliphatic hydrocarbon and aromatic hydrocarbon (B) | 6.0 parts by weight |
| Releasing agent E | 3.0 parts by weight |
| Magnetite (particle diameter: 0.2 μm) | 50.0 parts by weight |
| Negative chargeable charge controlling agent (Fe-containing azo dye) | 1.5 parts by weight |

The mixture is processed in the same manner as described in Example 22 to obtain toner particles and a developing agent.

Comparative Example 12

| | |
|---|---|
| Polyester resin (bisphenol A ethylene oxide adduct/bisphenol A propylene oxide adduct/maleic anhydride/terephthalic acid condensate, weight-average molecular weight 20000, softening point 120° C., glass transition point 65° C., acid value 15) | 55.5 parts by weight |
| Releasing agent E | 3.0 parts by weight |
| Magnetite (particle diameter: 0.2 μm) | 50.0 parts by weight |
| Negative chargeable charge controlling agent (Fe-containing azo dye) | 1.5 parts by weight |

The mixture is processed in the same manner as described in Example 22 to obtain toner particles and a developing agent.

Comparative Example 13

| | |
|---|---|
| Polyester resin (bisphenol A ethylene oxide adduct/bisphenol A propylene oxide adduct/maleic anhydride/terephthalic acid condensate, weight-average molecular weight 20000, softening point 120° C., glass transition point 65° C., acid value 15) | 39.5 parts by weight |
| Aliphatic hydrocarbon petroleum resin ($C_5$ petroleum fraction: isoprene/piperylene = 50/50 w/w) | 6.0 parts by weight |
| Releasing agent E | 3.0 parts by weight |
| Magnetite (particle diameter: 0.2 μm) | 50.0 parts by weight |
| Negative chargeable charge controlling agent (Fe-containing azo dye) | 1.5 parts by weight |

The mixture is processed in the same manner as described in Example 22 to obtain toner particles and a developing agent.

Comparative Example 14

| | |
|---|---|
| Polyester resin (bisphenol A ethylene oxide adduct/bisphenol A propylene oxide adduct/maleic anhydride/terephthalic acid condensate, weight-average molecular weight 20000, softening point 120° C., glass transition point 65° C., acid value 15) | 39.5 parts by weight |
| Aromatic hydrocarbon petroleum resin ($C_9$ petroleum fraction: α-methylstyrene | 6.0 parts by weight |
| Releasing agent E | 3.0 parts by weight |
| Magnetite (particle diameter: 0.2 μm) | 50.0 parts by weight |
| Negative chargeable charge controlling agent (Fe-containing azo dye) | 1.5 parts by weight |

The mixture is processed in the same manner as described in Example 22 to obtain toner particles and a developing agent.

For the toner particles and developing agent thus obtained in Examples 22 to 28 and Comparative Examples 12 to 14, the dispersion property of the releasing agent, the lowest fixing temperatures and the offset temperatures are evaluated in the same manner as described in Examples 1 to 10. In addition, image evaluations (image density, image upper line, sleeve filming, photosensitive body filming) are made as follows:

<Image evaluation>

Evaluation is carried out using a toner composition for electrophotography at a high temperature and high humidity (30° C./RH80%) with an ABLE 3321 copying machine manufactured by Fuji Xerox.

The evaluation is based on an initial image quality and an image quality after copying 5000 sheets. The image density is determined by an X-rite densitometer, and for the image upper lines, an evaluation is made based on a solid image after copying 5000 sheets.

<Photosensitive body filming>

The filming on a photosensitive body that occurs after copying 5000 sheets is evaluated visually in the above image evaluation method.

<Sleeve filming>

The filming on a sleeve that occurs after copying 5000 sheets is evaluated visually in the above image evaluation method.

The results are shown in Tables 5 and 6.

TABLE 5

| | Dispersion of Releasing Agent in Toner | | Lowest Fixing Temperature | | Offset Temperature | |
|---|---|---|---|---|---|---|
| No. | Dispersion Diameter | Evaluation | Temperature | Evaluation | Temperature | Evaluation |
| Example 22 | 0.42 μm | O | 130° C. | O | does not occur up to ~250° C. | O |
| Example 23 | 0.48 μm | O | 132° C. | O | does not occur up to ~251° C. | O |
| Example 24 | 0.35 μm | O | 133° C. | O | does not occur up to ~252° C. | O |
| Example 25 | 0.41 μm | O | 131° C. | O | does not occur up to ~253° C. | O |
| Example 26 | 0.45 μm | O | 130° C. | O | does not occur up to ~254° C. | O |
| Example 27 | 0.46 μm | O | 134° C. | O | does not occur up to ~255° C. | O |
| Example 28 | 0.38 μm | O | 133° C. | O | does not occur up to ~250° C. | O |
| Comparative Example 12 | 2.5 μm | X | 132° C. | X | does not occur up to ~250° C. | O |
| Comparative Example 13 | 1.3 μm | X | 132° C. | X | does not occur up to ~251° C. | O |
| Comparative Example 14 | 0.8 μm | X | 131° C. | X | does not occur up to ~250° C. | O |

TABLE 6

| | Initial Image Quality (high temperature and high humidity) | | Image Quality After 5,000 Sheets (high temperature and high humidity) | | | | | |
|---|---|---|---|---|---|---|---|---|
| | | | Image Density | | | | | |
| No | Density (SDA) | Evaluation | Density (SDA) | Evaluation | Image Upper Line | Photosensitive Body Filming | Sleeve Filming | Overall Evaluation |
| Example 22 | 1.55 | O | 1.45 | O | O | O | O | O |
| Example 23 | 1.53 | O | 1.43 | O | O | O | O | O |
| Example 24 | 1.46 | O | 1.37 | O | O | O | O | O |
| Example 25 | 1.48 | O | 1.39 | O | O | O | O | O |

TABLE 6-continued

| No | Initial Image Quality (high temperature and high humidity) Density (SDA) | Evaluation | Image Quality After 5,000 Sheets (high temperature and high humidity) Image Density Density (SDA) | Evaluation | Image Upper Line | Photosensitive Body Filming | Sleeve Filming | Overall Evaluation |
|---|---|---|---|---|---|---|---|---|
| Example 26 | 1.48 | O | 1.41 | O | O | O | O | O |
| Example 27 | 1.45 | O | 1.38 | O | O | O | O | O |
| Example 28 | 1.46 | O | 1.39 | O | O | O | O | O |
| Comparative Example 12 | 1.32 | X | 0.85 | X | XX | XX | X | XX |
| Comparative Example 13 | 1.21 | X | 0.98 | X | X | X | X | X |
| Comparative Example 14 | 1.15 | X | 0.87 | X | X | X | X | X |

1) Image Upper Line
O = not occurred
X = significant on image
2) Photosensitive body filming and sleeve filming
O = not observed visually on photosensitive body
X = a little occurred on image
XX = significant on image The results shown in Tables 5 and 6 demonstrate that each of the above properties is improved by adding resin copolymer of aliphatic hydrocarbon and aromatic hydrocarbon having 9 or more or carbons to a magnetic developing agent.

As described above, the present invention provides a toner for developing an electrostatic charge image, a developing agent for electrostatic charge image and image formation method, which provide both grindability and heat resistance, and have an extremely improved offset-resistance while maintaining a sufficient low temperature fixing property, have good grindability, and do not have harmful effects such as image faults due to filming on a photosensitive body or deterioration of charging property due to impaction to carrier.

What is claimed is:

1. A toner for developing an electrostatic charge image, comprising a colorant, a binding resin and a resin copolymer of an aliphatic hydrocarbon monomer and aromatic hydrocarbon monomer, said aromatic hydrocarbon monomer having 9 or more carbon atoms.

2. A toner for developing an electrostatic charge image of claim 1 wherein the resin copolymer is a petroleum resin copolymer.

3. A toner for developing an electrostatic charge image of claim 1, wherein the toner further comprises a wax.

4. A toner for developing an electrostatic charge image of claim 3, wherein the endothermic peak of the wax in DSC is in the range from 70 to 100° C.

5. A toner for developing an electrostatic charge image of claim 1, wherein the amount of the resin copolymer is from 2 to 50 parts by weight per 100 parts by weight of the binding resin.

6. A toner for developing an electrostatic charge image of claim 1, wherein the resin copolymer has a ring and ball softening point of from 80 to 170° C.

7. A toner for developing an electrostatic charge image of claim 1, wherein the binding resin is a polyester resin.

8. A toner for developing an electrostatic charge image of claim 4, wherein the binding resin is a polyester resin.

9. A toner for developing an electrostatic charge image of claim 1, wherein the softening point of the binding resin is from 80 to 150° C. and the glass-transition point of the binding resin is from 55 to 75° C.

10. A toner for developing an electrostatic charge image of claim 3, wherein the amount of the wax is from 0.1 to 20 parts by weight per 100 parts by weight of the binding resin.

11. A toner for developing an electrostatic charge image of claim 1, wherein the weight ratio of aromatic hydrocarbon monomer to aliphatic hydrocarbon monomer in the resin copolymer is from 99:1 to 50:50.

12. A toner for developing an electrostatic charge image of claim 1, wherein the resin copolymer comprises at least one monomer selected from the group consisting of isoprene, piperylene, 2-methylbutene-1 and 2-methylbutene-2 as an aliphatic hydrocarbon component and at least one monomer selected from the group consisting of vinyl toluene, α-methylstyrene, indene and isopropenyl toluene as an aromatic hydrocarbon component.

13. A toner for developing an electrostatic charge image of claim 1, wherein the colorant is a magnetic material.

14. A developing agent for electrostatic charge image having carrier and toner, wherein the toner comprises a colorant, a binding resin and a resin copolymer of an aliphatic hydrocarbon monomer and aromatic hydrocarbon monomer, said aromatic hydrocarbon monomer having 9 or more carbon atoms.

15. A developing agent for electrostatic charge image of claim 14, wherein the resin copolymer is a petroleum resin copolymer.

16. A developing agent for electrostatic charge image of claim 14, wherein the toner further comprises a wax.

17. A developing agent for electrostatic charge image of claim 14, wherein the carrier has a resin-coated layer.

18. An image formation method comprising forming an electrostatic latent image on an electrostatic latent image holding member, and developing said electrostatic latent image on the electrostatic latent image holding member by using a developing agent layer on a developing agent carrying member to form an image, wherein the developing agent comprises a colorant, a binding resin and a resin copolymer of an aliphatic hydrocarbon monomer and an aromatic hydrocarbon monomer, said aromatic hydrocarbon monomer having 9 or more carbon atoms.

19. An image formation method of claim 18, wherein the resin copolymer is a petroleum resin copolymer.

20. An image formation method of claim 18, wherein the developing agent further comprises a wax.

21. A developing agent for electrostatic charge image of claim 14, wherein the amount of the resin copolymer is from 2 to 50 parts by weight per 100 parts by weight of the binding resin.

22. An image formation method of claim 18, wherein the amount of the resin copolymer is from 2 to 50 parts by weight per 100 parts by weight of the binding resin.

* * * * *